US006827156B1

(12) United States Patent
Hsiao

(10) Patent No.: US 6,827,156 B1
(45) Date of Patent: Dec. 7, 2004

(54) VIBRATION SUPPRESSING DEVICE FOR AIR HAMMER

(76) Inventor: Wen-Liang Hsiao, 1F, No. 6, Alley 1, Lane 186, Kangle Street, Neihu District, Taipei 114 (TW)

( * ) Notice: Subject to any disclaimer, the term of this patent is extended or adjusted under 35 U.S.C. 154(b) by 0 days.

(21) Appl. No.: 10/664,955

(22) Filed: Sep. 22, 2003

(51) Int. Cl.[7] ..... B25D 9/00
(52) U.S. Cl. ..... 173/212; 173/17; 173/168
(58) Field of Search ..... 173/210, 211, 173/212, 162.1, 128, 206, 168, 17, 207

(56) References Cited

U.S. PATENT DOCUMENTS

| | | | | |
|---|---|---|---|---|
| 3,223,181 A | * | 12/1965 | Price | 173/18 |
| 3,446,291 A | * | 5/1969 | Wickersheim et al. | 173/17 |
| 3,727,700 A | * | 4/1973 | Amtsberg | 173/18 |
| 5,533,579 A | * | 7/1996 | Chu | 173/17 |
| 5,944,120 A | * | 8/1999 | Barden | 173/212 |
| 6,105,686 A | * | 8/2000 | Niemi | 173/208 |
| 6,364,032 B1 | * | 4/2002 | DeCord et al. | 173/90 |

* cited by examiner

*Primary Examiner*—Scott A. Smith

(74) *Attorney, Agent, or Firm*—Rosenberg, Klein & Lee

(57) ABSTRACT

An air hammer includes an air hammering mechanism and a vibration suppressing device to absorb the vibration transmitted from the air hammering mechanism. The vibration suppressing device includes a cylinder forming a front channel and a rear channel in communication with each other. First and second air passageways are defined in the cylinder and in communication with the front and rear channels respectively. A valve is movably received in the front channel. The valve defines a bore and third air passageways selectively alignable with the first air passageways. A piston is movably received in the rear channel and forms a projection. A jacket surrounds the cylinder to form therebetween an air chamber that communicates the second air passageways. The jacket has a closed end defining a hole into which the projection is selectively received to block the hole. When the air hammering mechanism is driven by compressed air, the compressed air is allowed to simultaneously flow into the valve via the first and third air passageways to move the piston in such a way to have the projection of the piston received into the hole and thus closing the hole for sealing the air chamber. The compressed air is allowed to further flow into the air chamber via the second air passageways. The compressibility of the air inside the sealed air chamber functions to absorb vibration transmitted from the air hammering mechanism.

1 Claim, 3 Drawing Sheets

VIBRATION SUPPRESSING DEVICE FOR AIR HAMMER

BACKGROUND OF THE INVENTION

1. Field of the Invention

The present invention generally relates to an air hammer and in particular to a device incorporated in the air hammer for suppressing vibration caused by the operation of the air hammer.

2. The Related Art

Air hammers are widely employed in many fields, such as construction and automobile. Although the air hammer is one of the most commonly used tools in these fields, hazard to an air hammer operator caused by the powerful vibration inherent in the air hammer is the worst drawback for the air hammer. Designers and manufacturers of the air hammer or similar tools have been devoted to the development of vibration reduced or vibration suppressed air tools and such vibration reduced or vibration suppressed air tools are nowadays available in the market.

Examples of the vibration reduced air tools are Taiwan Patent Application Nos. 88219204 and 89204911. The former provides an air chisel comprising a spring based vibration reducing device arranged between an air hammering mechanism and a casing of the air chisel. By means of the resiliency or springing force of the spring based device, the vibration caused by air hammering mechanism is reduced. The later also provides a vibration reducing device comprised of coiled springs arranged on front and rear sides of an air hammering mechanism to suppress the transmission of vibration caused by the air hammering mechanism.

A common drawbacks shared these conventional devices is that the spring is subject to mechanical fatigue after long term and frequent operations. The spring must be replaced once the fatigue occurs. This increases the overall costs of using an air tool. In addition, the springs employed in the vibration reducing devices of the conventional air tools does not ensure a stable behavior in suppressing the transmission of vibration to an operator of the air tools.

SUMMARY OF THE INVENTION

Thus, the primary object of the present invention is to provide a vibration suppressing device to be incorporated in an air hammer to overcome the above drawbacks of the conventional air hammering devices.

Another object of the present invention is to provide a vibration suppressing device for air hammer, having a simple structure and thus low costs, to effectively suppress the transmission of vibration caused by an air hammering mechanism of the air hammer.

A further object of the present invention is to provide a vibration suppressing device for air hammer, which has relatively long service life without the need of replacing fatigued parts and which does not adversely affect the output power of the air hammer.

To achieve the above objects, in accordance with the present invention, there is provided an air hammer comprising an air hammering mechanism and a vibration suppressing device to absorb the vibration transmitted from the air hammering mechanism. The vibration suppressing device comprises a cylinder forming a front channel and a rear channel in communication with each other. First and second air passageways are defined in the cylinder and in communication with the front and rear channels respectively. A valve is movably received in the front channel. The valve defines a bore and third air passageways selectively alignable with the first air passageways. A piston is movably received in the rear channel and forms a projection. A jacket surrounds the cylinder to form therebetween an air chamber that communicates the second air passageways. The jacket has a closed end defining a hole into which the projection is selectively received to block the hole. When the air hammering mechanism is driven by compressed air, the compressed air is allowed to simultaneously flow into the valve via the first and third air passageways to move the piston in such a way to have the projection of the piston received into the hole and thus closing the hole for sealing the air chamber. The compressed air is allowed to further flow into the air chamber via the second air passageways. The compressibility of the air inside the sealed air chamber functions to absorb vibration transmitted from the air hammering mechanism.

BRIEF DESCRIPTION OF THE DRAWINGS

The present invention will be apparent to those skilled in the art by reading the following description of a preferred embodiment thereof, with reference to the attached drawing, in which.

DETAILED DESCRIPTION OF THE PREFERRED EMBODIMENT

Figure 1:
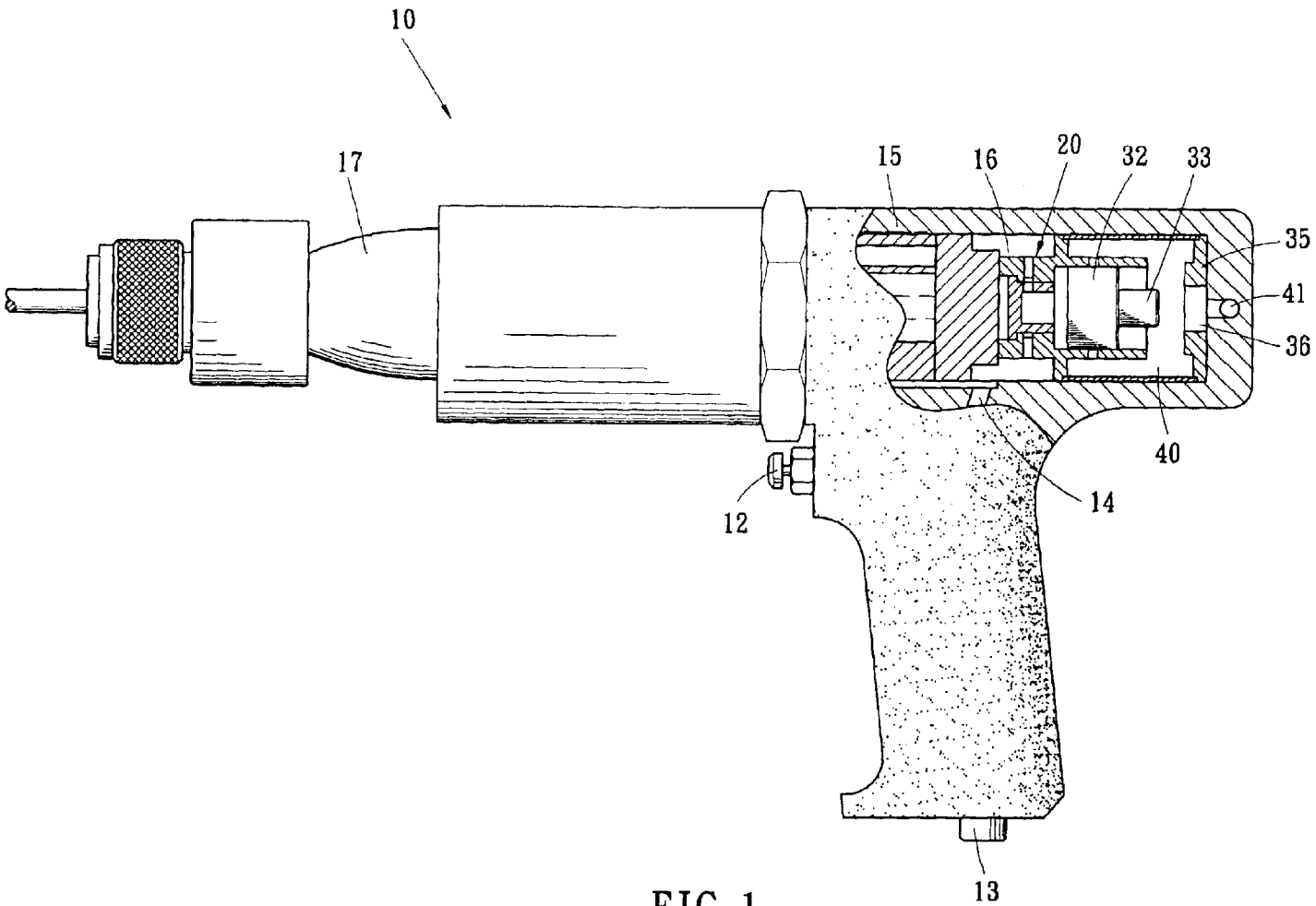
FIG. 1 is a side elevational view, partially broken, of an air hammer in which a vibration suppressing device constructed in accordance with the present invention is incorporated.

With reference to the sole drawing, FIG. 1, an air hammer, generally designated with reference numeral 10, comprises casing 15 inside which an air hammering mechanism 17 and a vibration suppressing device 20 constructed in accordance with the present invention are mounted. The casing 15 forms an extension serving as a handle 11 for hand gripping by an operator. A compressed air inlet 13 is formed on a bottom (not labeled) of the handle 11 for receiving compressed air flow from an external compressed air source (not shown). A control trigger 12 is provided on the handle 11 for controlling the compressed air flow through the inlet 13. Once the control trigger 12 is actuated, the compressed air flows through the inlet 13 and an air passage 14 extending from the inlet 13 into a primary air chamber 16 defined inside the casing 15 to pneumatically operate the air hammering mechanism 17.

The air hammering mechanism 17 is well known in the art and constitutes no novel parts of the present invention. Thus, no further detail of the air hammering mechanism 17 is needed herein.

Figure 2:
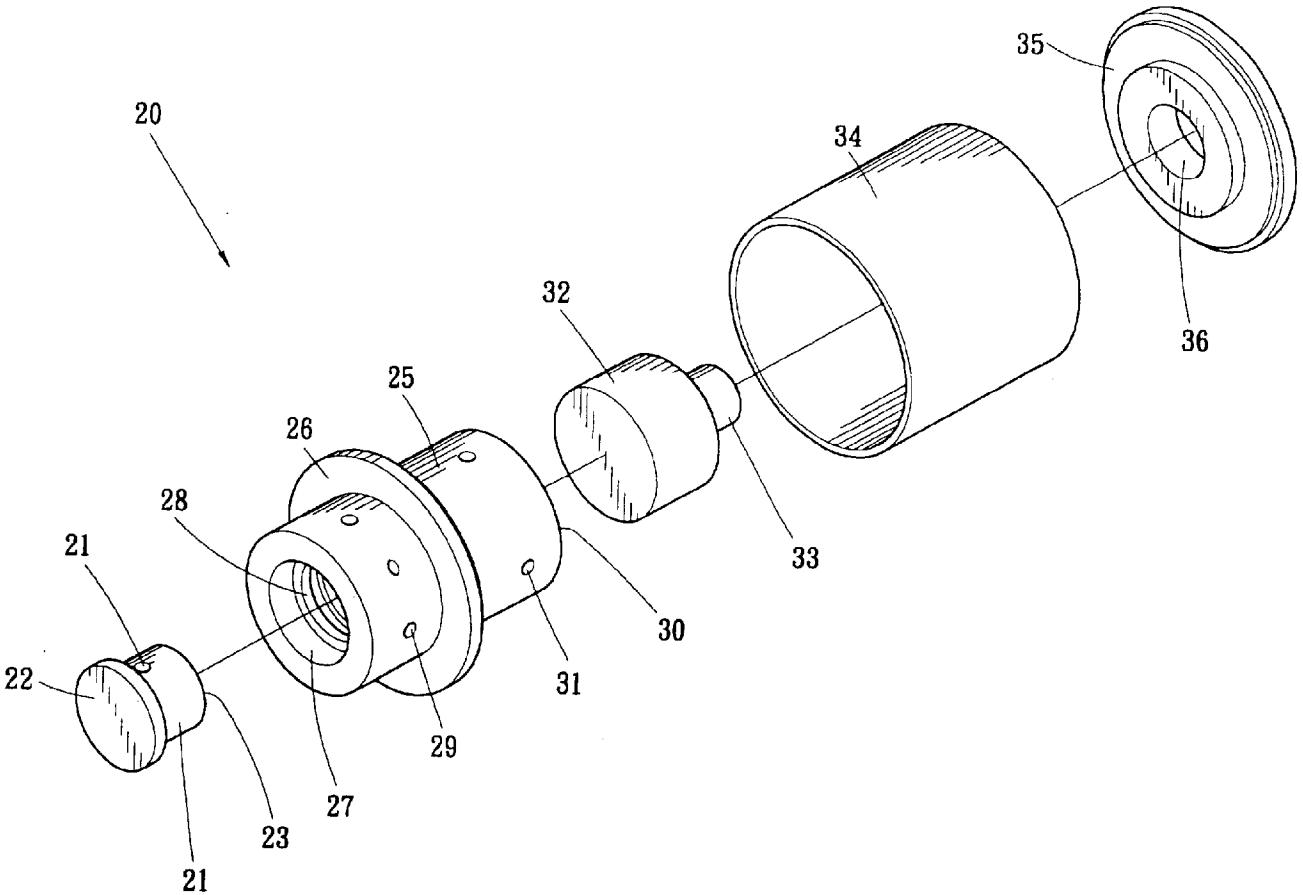
FIG. 2 is an exploded view of the vibration suppressing device in accordance with the present invention.
Figure 3:
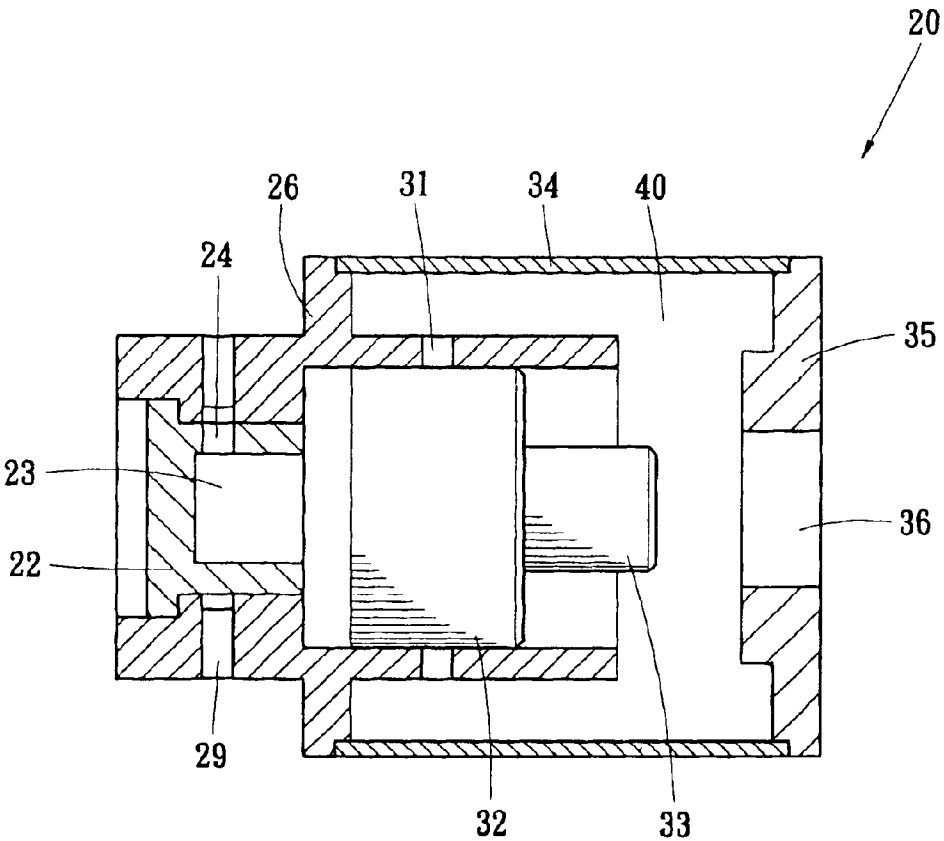
FIG. 3 is a cross-sectional view of the vibration suppressing device in accordance with the present invention.

Also referring to FIGS. 2 and 3, the vibration suppressing device 20 comprises a cylinder 25 in the form of a cylindrical hollow body having an interior space comprised of front and rear halves (not labeled) in which a front circular cavity 27 and rear channel 30 are defined. A front channel 28 is defined in the front halve of the cylinder 25 and extending to and between the front cavity 27 and the rear channel 30 for communicating the cavity 27 with the rear channel 30. The front channel 28 is concentric with the cavity 27 and has a smaller diameter thereby forming a circumferential shoulder (not labeled) between the front channel 28 and the cavity 27. The cylinder 25 forms a circumferential flange 26 on an outer surface thereof substantially between the front and rear halves thereof.

A cylindrical outer jacket 34 is fit over the rear halve of the cylinder 25 and mounted to the flange 26 of the cylinder 25. Preferably, the flange 26 forms a recess or circumferential shoulder (not labeled) to receive a front end of the jacket 34 in for example a force fitting manner or other known means thereby securing the jacket 34 to the cylinder 25. The jacket 34 is spaced from the rear halve of the cylinder 25 thereby forming a secondary air chamber 40 of the air hammer 10 that is circumferential about the cylinder 25. An end lid 35 is fit over a rear end of the jacket 34 to seal the secondary air chamber 40. The end lid 35 defines a central hole 36 facing the rear channel 30 of the cylinder 25.

A valve 21 takes the form of a short cylinder movably received in the front channel 28 and defining a central bore 23. The valve 21 has an expanded closed front end 22 forming a circumferential flange (not labeled) received in the cavity 27 and resting on the circumferential shoulder between the front channel 28 and the cavity 27. In the cylinder of the valve 21, a plurality of air radially extending passages 24 is defined and communicating the central bore 23. A plurality of air passageways 29 is defined in the front halve of the cylinder 25 in communication with the front channel 28. At least one of the air passageways 29 is positionable to substantially align with one of the air passages 24 of the valve 21 to allow air flow into the central bore 23 of the valve 21.

A piston 32 is movably received in the rear channel 30 of the cylinder 25. The piston 32 is reciprocally movable with respect to the cylinder 25 in a front-to-rear direction and the relative movement of the piston 32 is limited by a circumferential step (not labeled) formed between the front channel 28 and the rear channel 30. The piston 32 has a rearward extending projection 33, preferably cylindrical, that faces the end lid 35 and is snugly and movably fit into the central hole 36 of the end lid 35 in a rearward stroke of the piston 32. The fitting of the projection 33 into the central hole 36 of the end lid 35 functions to close the hole 36 and thus seals the secondary air chamber 40. Disengaging the projection 33 from the hole 36 opens the hole 36 and releasing air from the secondary air chamber 40.

Air passageways 31 are defined in the rear halve of the cylinder 35 whereby when the projection 33 of the piston 32 is fit into the hole 36 of the end lid 35 in the rearward stroke, the air passageways 31 communicate between the secondary air chamber 40 and the rear channel 30 of the cylinder 35.

The vibration suppressing device 20 is received in the housing 15 of the air hammer 10 with the jacket 34 securely fit in an interior space of the housing 15. The front halve of the cylinder 25 is radially spaced from an inside surf ace of the casing 15 to define the primary air chamber 16 whereby air is allowed to flow between the primary air chamber 16 and the central bore 23 of the valve via the air passageways 29 of the cylinder 25 and the air passages 24 of the valve 23. In addition, the hole 36 of the end lid 35 is in communication with a release channel 41 defined in the casing 15 of the air hammer 10 for discharging the air from the secondary air chamber 40 to the surroundings.

In operation of the air hammer 10, compressed air flows into the primary air chamber 16 via the inlet 13 and the air passage 14 to drive the air hammering mechanism 17. The compressed air in the primary air chamber 16 is also allowed to flow into the central bore 23 of the valve 21 thereby forcing the valve 21 and the piston 32 to move in opposite direction and away from each other. Namely, the valve 21 is moved frontward while the piston 32 is moved rearward in a rearward stroke. At the same time, the compressed air flows into the rear channel 30 of the cylinder 25.

The projection 33 is thus moved into the central hole 36 of the end lid 35 thereby closing the hole 36 while opening the air passageways 31. The compressed air then flows into the secondary air chamber 40 via the air passageways 31. Due to the compressibility of the air inside the secondary air chamber 40, the secondary air chamber 40 effectively absorbs the vibration energy transmitted from the operating air hammering mechanism 17.

Instead of using a spring as a vibration absorbing element in the conventional designs of air hammers, the vibration suppressing device of the present invention makes use of the compressibility of air inside the secondary air chamber to absorb the vibration caused by the air hammering mechanism, which not only effectively reduce the vibration transmitted to an operator of the air hammer, but also completely eliminates the fatigue problem encountered in the conventional air hammer designs.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A vibration suppressing device adapted to be incorporated in an air hammer comprising an air hammering mechanism, the vibration suppressing device comprising:

a cylinder forming a front channel and a rear channel in communication with each other, at least one first air passageway defined in the cylinder and in communication with the front channel and at least one second air passageway defined in the cylinder and in communication with the rear channel;

a valve movably received in the front channel, the valve defining a bore and at least one third air passageways selectively alignable with the first air passageway;

a piston movably received in the rear channel and forming a projection;

a jacket mounted to and surrounding the cylinder to form an air chamber therebetween, the second air passageway being in communication with the air chamber; the jacket having a closed end facing the projection of the piston and defining a hole into which the projection is selectively received to block the hole;

wherein when the air hammering mechanism is driven by compressed air, the compressed air is allowed to simultaneously flow into the valve via the first and third air passageways to move the piston in a first stroke whereby the projection of the piston is received into the hole and thus closing the hole for sealing the air chamber and wherein the compressed air is allowed to further flow into the air chamber via the second air passageway, compressibility of the air inside the sealed air chamber functioning to absorb vibration transmitted from the air hammering mechanism.

* * * * *